United States Patent [19]

Cross

[11] 4,341,044

[45] Jul. 27, 1982

[54] MACHINE FOR GRINDING GASHES IN END MILL CUTTERS

[75] Inventor: James R. Cross, Florissant, Mo.

[73] Assignee: McDonnell Douglas Corporation, St. Louis, Mo.

[21] Appl. No.: 151,269

[22] Filed: May 19, 1980

[51] Int. Cl.[3] ..... B24B 3/06

[52] U.S. Cl. ..... 51/5 D; 51/33 R; 51/225

[58] Field of Search ..... 51/5 D, 33 R, 33 W, 51/288, 96, 225; 125/11 TP

[56] References Cited

U.S. PATENT DOCUMENTS

| | | | |
|---|---|---|---|
| 3,543,445 | 12/1970 | Borchert | 51/33 R |
| 3,630,187 | 12/1971 | Vossenbrecher | 125/11 TP |
| 3,680,262 | 8/1972 | Aydelott et al. | 51/288 |
| 3,680,263 | 8/1972 | Johnson | 51/288 |
| 4,115,956 | 9/1978 | Huffman | 51/96 |
| 4,134,235 | 1/1979 | Maharidge | 51/225 |
| 4,163,345 | 8/1979 | Meili | 51/225 |

*Primary Examiner*—Nicholas P. Godici
*Attorney, Agent, or Firm*—Gravely, Lieder & Woodruff

[57] ABSTRACT

A grinding machine for automatically cutting gashes into the end of a fluted end mill blank includes a base on which a grinding wheel is supported such that it moves back and forth tracing a swing path. The end mill blank is held in a work head that is supported upon a vertical slide which is in turn mounted upon a horizontal slide that moves over the base. The work head pivots about two axes for positioning the end mill blank at the proper angle with respect to the grinding wheel. A feed assembly advances the horizontal slide incrementally, and at the same time moves a control slide that actuates various switches which control the operation of the machine. The feed assembly also shifts the vertical slide at the proper time within the grind cycle. In addition the machine has a wheel dresser which automatically dresses the grinding wheel when the feed assembly shifts from a rough feed to a fine feed.

22 Claims, 17 Drawing Figures

MACHINE FOR GRINDING GASHES IN END MILL CUTTERS

BACKGROUND OF THE INVENTION

This invention relates to grinding machines, and more particularly to a grinding machine for generating end cutting teeth in end mill cutters by gashing.

An end mill cutter, which is often referred to simply as an end mill, is a metal cutting tool of cylindrical shape having cutting teeth along both its periphery and one of its ends. This renders the tool suitable for recess work as well as a wide variety of other milling operations.

To manufacture an end mill, cylindrical bar stock, which should be high speed tool steel, is milled along its cylindrical surface to provide flutes which extend all the way up to one of the end faces. Next the steel is hardened in a heat treatment process. Then the edges of the flutes are ground to establish the peripheral cutting edges.

To establish the cutting teeth at the end of the tool, the end face of the cylindrical bar is first dished about one to three degrees so that the center of its end face is slightly deeper than the periphery. Next it is ground in a gashing operation to provide gashes which open out of the dished end face and generally align with the flutes. The gashes in effect create end cutting teeth at the end of the tool, there being a separate tooth at the end of each flute. Then primary and secondary surfaces are ground into the end face between gashes in a facing operation to establish cutting edges with the back surfaces of the gashes and trailing clearances. Finally, radii are ground into the tool to merge the end cutting edges along the gashes and peripheral cutting edges along the flutes. Since the teeth at the end of the tool are generated on hardened tool steel, the dishing, gashing, facing and radiusing operations are all achieved by grinding with an abrasive wheel.

Moreover, dull or damaged end mills are reconditioned by cutting off their ends, regrinding their flutes, and then establishing a new set of end teeth by the foregoing dishing, gashing, facing and radiusing operations.

Most end mills are gashed on a universal tool grinders that are manually operated. As a consequence, the quality of the grind depends to a large measure on the skill and judgment of the operator, but even with skilled grinding machine operators, the finish grinds for the gashes vary from one end mill to another. Moreover, the grinding is tedious and time consuming work requiring the skills of experienced machine operators. Aside from that, the typical universal tool grinder has a relatively small grinding wheel and a low powered motor to drive it, and this necessitates frequent dressings of the wheel. This is likewise a manual operation which can affect the geometry of the gashes that are eventually cut. Furthermore, the grinding wheel of a universal tool grinder operates dry since the grinder does not accomodate a coolant system, and this can cause excessive temperatures and reduce the metal hardness along the cutting edges of the end mill—the very regions which should remain as hard as possible.

SUMMARY OF THE INVENTION

One of the principal objects of the present invention is to provide a machine for gashing end mills on an automatic basis once the machine is loaded. Another object is to provide a machine of the type stated which utilizes a large diameter grinding wheel that is driven by a high powered motor and requires relatively few wheel dressings. A further object is to provide a gashing machine of the type stated that automatically dresses its grinding wheel immediately before the final finish grinds are made. An additional object is to provide a grinding machine of the type stated that is capable of cutting gashes into the ends of 2, 4, and 6 flute end mill blanks. Still another object is to provide a machine of the type stated that is capable of gashing end mill blanks of a wide range of diameters and lengths. Yet another object is to provide a gashing machine of the type stated having a coolant system which permits rapid stock removal without generating excessive temperatures. These and other objects and advantages will become apparent hereinafter.

The present invention is embodied in a machine having a base, a grinding wheel upon the base, means for moving the grinding wheel along a path; a work head on the base for holding a cutting tool blank and being capable of rotating the blank about its axis to place different portions of it opposite the path of the grinding wheel, feed means for advancing the work head generally radially with respect to the axis of the grinding wheel and for shifting the work head generally parallel to the axis of the grinding wheel. The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur.

DETAILED DESCRIPTION

Figure 1:
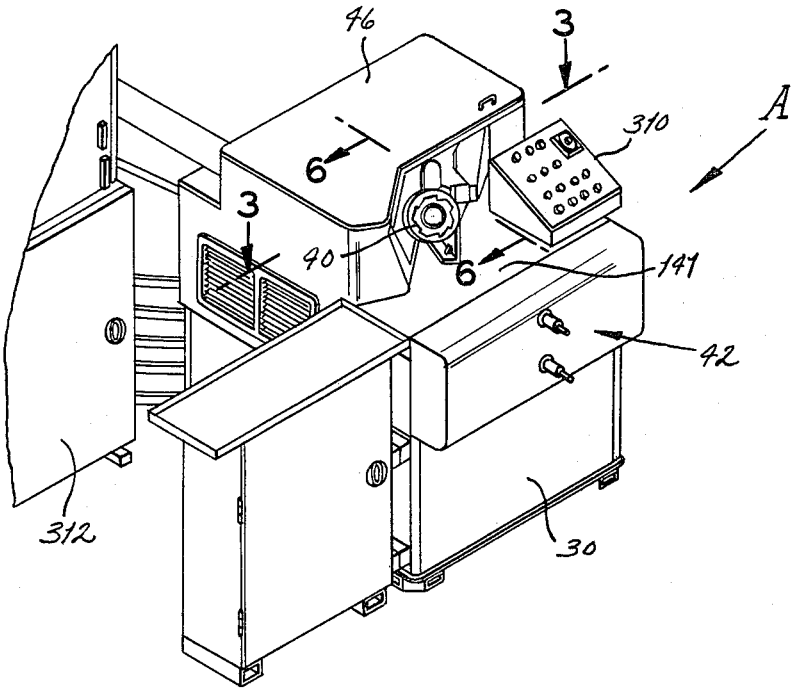
FIG. 1 is a perspective view of a grinding machine constructed in accordance with and embodying the present invention.
Figure 6:
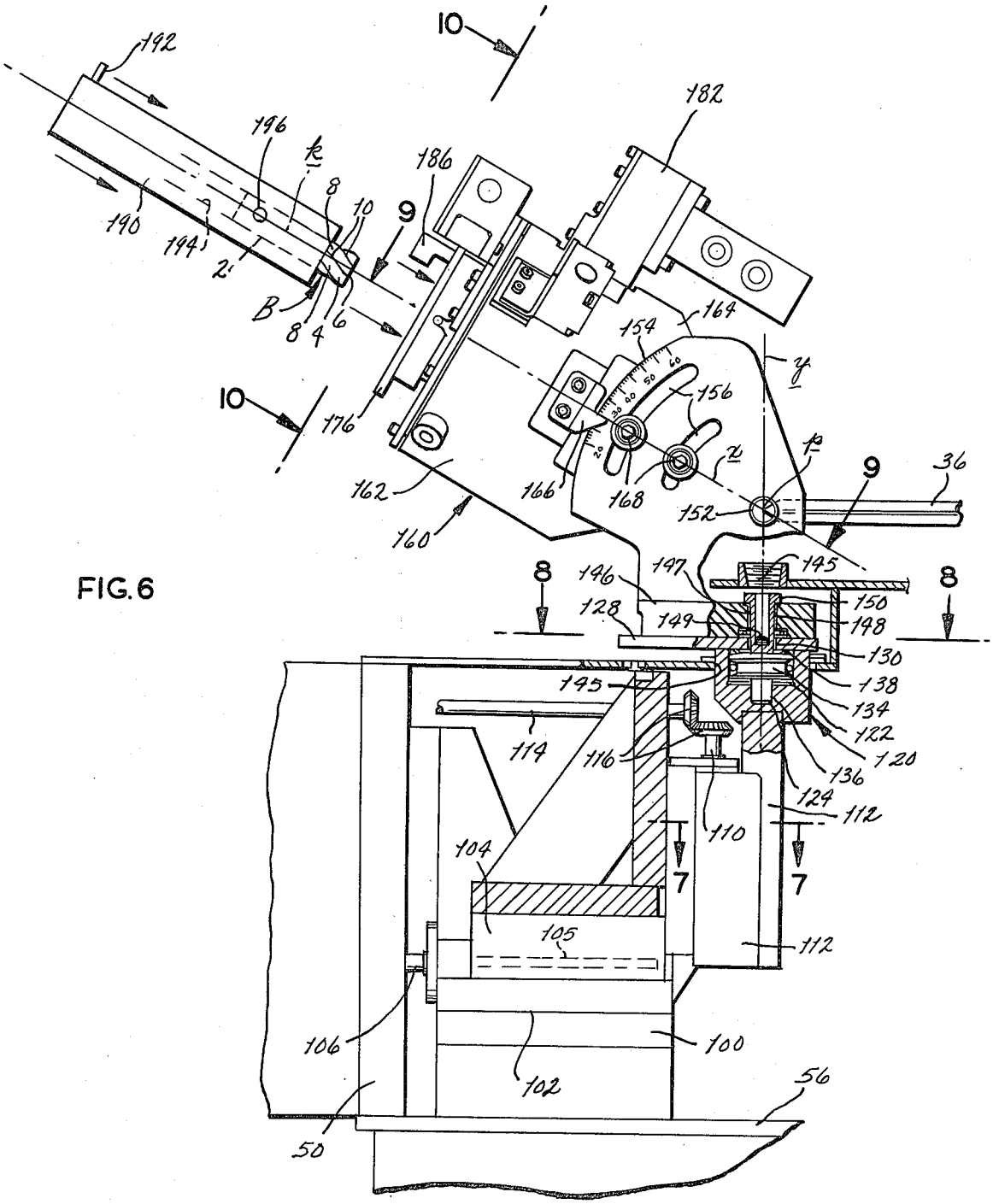
FIG. 6 is a section view taken along line 6—6 of FIG. 1 and showing the horizontal and vertical slides as well as the work head assembly which is positioned by those slides.
Figure 17:
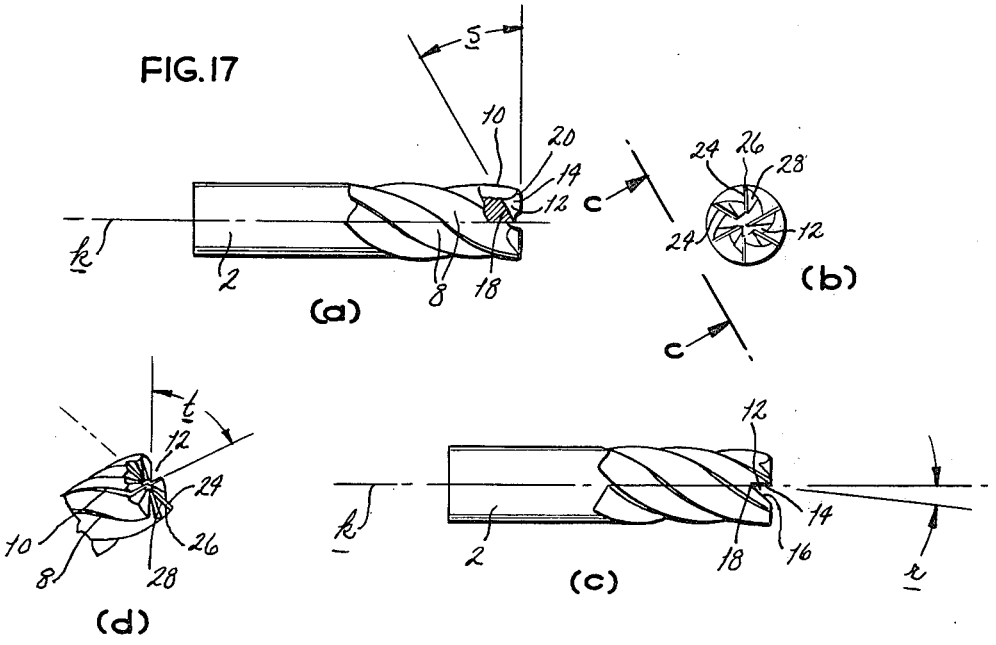
FIG. 17 illustrates a fully ground end mill into which gashes have been cut by the machine of the present invention.

Referring now to the drawings (FIG. 1), a grinding machine A automatically cuts gashes into the end of a fluted end mill blank B (FIG. 6) and in so doing performs one of the more critical grinding operations that eventually provide the blank B with end cutting teeth (FIG. 17). The machine A once it has been hand loaded, operates fully automatically and is capable of cutting two, four, or six gashes into the end mill blank B, the number of gashes of course depending on the number of flutes in the blanks.

Considering first the end mill blank B (FIG. 6) that is to be ground on the machine A, it includes a shank 2 and a cutting portion 4 which forms an integral continuation of the shank 2 and terminates at an end face 6. Both the shank 2 and the cutting portion 4 are on the same axis K which is the axis about which the end mill rotates in a milling operation. The cutting portion 4 contains spiral flutes 8 which extend all the way to the end face 6, and along these flutes the cutting portion 4 is ground to provide peripheral cutting edges 10. The end face 6, while appearing planer and perpendicular to the axis K, is actually dished so that its center is slightly deeper than its periphery, the extent of the dishing being about 1° to 3°. The end mill blank B may represent the products of certain machining operations in the original manufacture of end mills or it may be derived from a used end mill that has been cut off.

The grinding machine A cuts into the end mill blank B to provide it with gashes 12 (FIG. 17) that open axially out of the end face 6 and radially into the flutes 8. Hence the gashes 12 correspond in number to the flutes 8. In an end mill having 4 or 6 gashes 10, two of the gashes 12 are cut somewhat deeper than the remaining gashes 12, these gashes 12 being located 180° from each other and extending all the way to the center of the end face 6 which is at the axis K. The remaining gashes 12, of course, terminate short of the axis K. Each gash 12 has a V-shaped configuration and is bounded by two surfaces, namely, a rake face 14 and a heel face 16, and these faces merge at a valley 18 that extends outwardly and rearwardly away from the center of the end face 6. The rake face 14 is presented in the direction in which the end mill turns in a milling operation, and the angle between it and an intersecting plane passing through the axis X is known as the rake angle r. The angle between the valley 18 and a plane perpendicular to the axis k is known as the gash angle S. The angle between the rake and heel faces 14 and 16 at any gash 12 is known as the bottom gash angle t. Each gash 12 is positioned such that its rake face 14 intersects the spiral cutting edge 10 on the flute 8 with which the gash 12 aligns, thereby providing a short laterally directed extension 20 of the rake face 14 beyond the end of the flute 8.

In the completed end mill (FIG. 17) each rake face 14 intersects a primary end surface 22, which is derived from a further grinding of the end face 6, all to provide a sharp radially directed cutting edge 24. The primary surface 22 is quite narrow in that it is followed by a secondary surface 26 which is ground into the primary surface 22 at a steeper angle. The secondary surfaces 26 lead into the heel faces 16 of the gashes 12, and provide clearance behind the cutting edges 24 so that chips may enter the flutes 8. The grinding operations in which the primary and secondary surfaces 22 and 26 are formed are known as facing.

Figure 3:
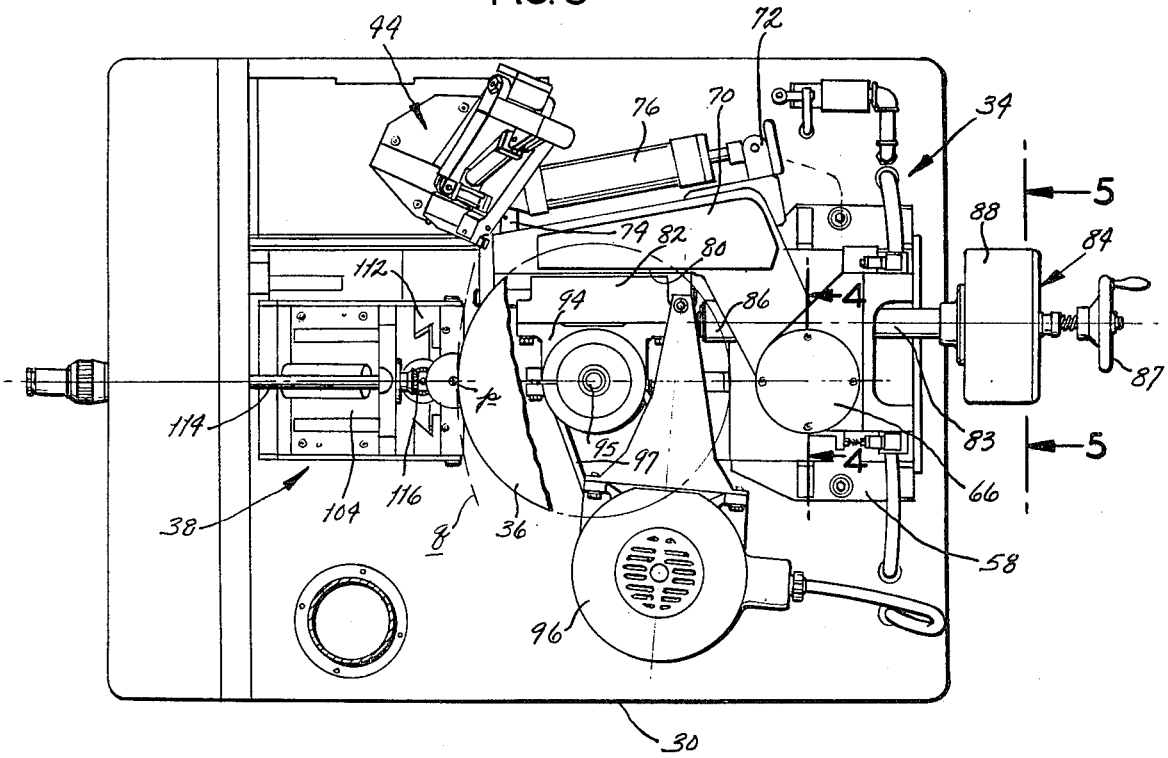
FIG. 3 is a sectional view taken along line 3—3 of FIG. 1 and showing primarily the swing arm assembly of the grinding machine.
Figure 2:
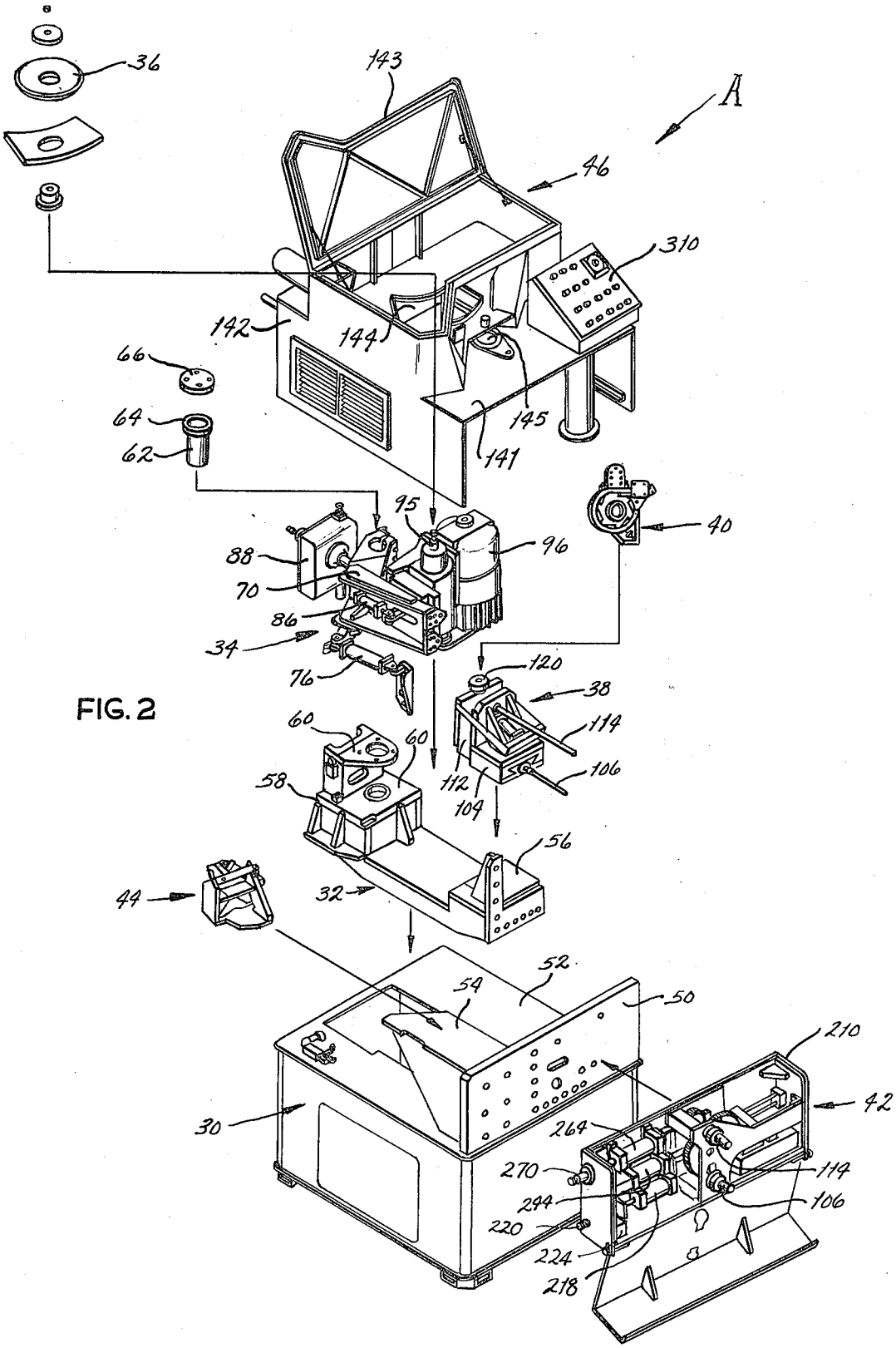
FIG. 2 is an exploded perspective view of the machine, showing its various major components.
Figure 9:
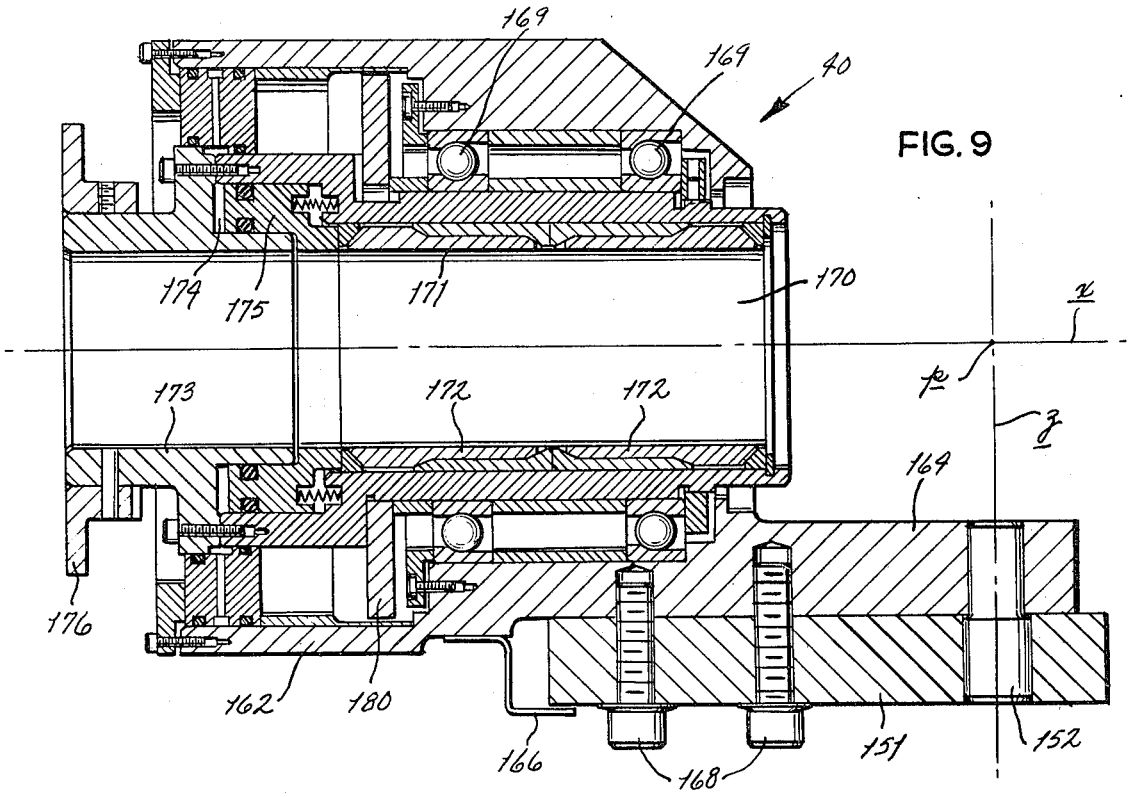
FIG. 9 is a sectional view taken along line 9—9 of FIG. 6 and showing the interior of the work head assembly.

The grinding machine A includes several major assemblies (FIG. 2), namely, a base 30; a main frame 32 that is supported in a fixed position on the base 30; a swing arm assembly 34 that is mounted on the frame 32 and carries a rotating grinding wheel 36; a slide assembly 38 that is also mounted on the main frame 32; a work head assembly 40 that is mounted on the slide assembly 38 and positioned by it; a feed assembly 42 for advancing the slides of the slide assembly 38 and thereby changing the position of the work head assembly 40 relative to the grinding wheel 36; a wheel dresser 44 that is mounted on the base 30 for dressing the grinding wheel 36; and a cover 46 that fits over and encloses the frame 32, the swing arm assembly 34, the grinding wheel 36, and the wheel dresser 44. The end mill blank B into which the gashes 12 are to be ground is held in the work head assembly 40 such that the center of the end face 6 is initially at a grinding point p (FIGS. 3, 6, and 9) past which the periphery of the grinding wheel 36 moves when the swing arm assembly 34 is in operation.

The base 30 (FIGS. 1 & 2) rests on a floor and includes upright mounting plate 50 to which both the frame 32 and the feed assembly 42 are bolted. It also includes a horizontal positioning surface 52 and a mounting plate 54 which is located above the positioning surface 52.

Figure 4:
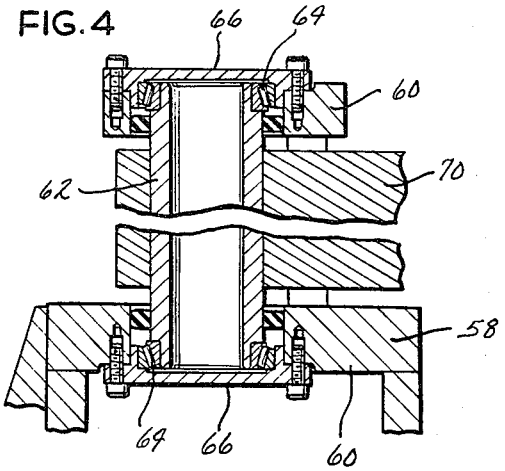
FIG. 4 is a sectional view taken along line 4—4 of FIG. 3 and showing the swing arm shaft on which the swing arm pivots.

The main frame 32 rests on the horizontal positioning surface 52 of the base 30 (FIG. 2) and is bolted against both that surface and the rearwardly presented surface of the mounting plate 50. At the front of the frame 32 is a short pedestal 56 on which the slide assembly 38 is mounted. At the rear of the frame 32 is another pedestal 58 having spaced apart horizontal plates 60 (FIG. 4) through which a vertical swing arm shaft 62 extends. Indeed that shaft 62 is at its ends pressed into tapered roller bearings 64 which are in turn received in end caps 66 that are bolted firmly against the plates 60 so that the shaft 62 is capable of rotating about an axis that is vertical and parallel to the axis of rotation for the grinding wheel 40. The two tapered roller bearings 64 are positioned in the direct configuration and are adjusted to a condition of slight preload to eliminate all radial and end play.

The swing arm assembly 34 (FIGS. 2 and 3) is in essence carried on the shaft 62 of the main frame 32 and indeed pivots about the axis of the shaft 62. To this end the swing arm assembly 34 includes a swing arm 70 which at its one end fits between the two plates 60 of the main frame 32 where it is clamped around the swing arm shaft 62. The arm 70 projects outwardly from the space between the two plates of 60, first laterally and then generally forwardly toward the upright mounting plate 50 on the base 30. In the region where it turns forwardly, the arm 70 is provided with a bracket 72 that is aligned with another bracket 74 which is bolted to the side of the main frame 32 close to the front pedestal 56. Connected between the two brackets 72 and 74 is a double acting hydraulic cylinder 76 which, when activated, causes the swing arm 70 to swing to and fro about the vertical axis of the shaft 62 so that the forward end of the arm 70 traces an arcuate path immediately behind the slide assembly 38 and the wheel dresser 44.

The swing arm 70 carries a horizontally slideway 80 (FIG. 3) that extends generally forwardly and rearwardly, and mounted upon the slideway 80 is a slide 82. The position of the slide 82 upon the slideway 80 is controlled by a feed mechanism 84 that is likewise mounted on the swing arm 70 and includes a feed screw 83 that threads into a nut on slide 82. In addition, the swing arm 70 has a small pneumatic cylinder 86 that is also connected with the slide 82 and when energized thrusts the slide 82 forwardly or rearwardly to take up any lost motion in the feed screw 83, the direction in which the slide 82 is thrust being dependent on whether the grinding wheel 36 is being dressed or is grinding an end mill blank B.

Figure 5:
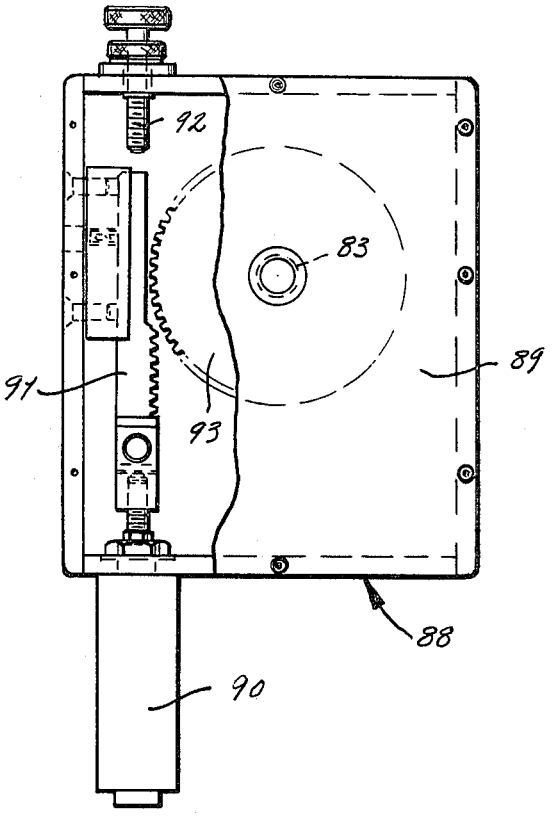
FIG. 5 is a sectional view taken along line 5—5 of FIG. 3 and showing the indexing unit for advancing the grinding wheel forwardly toward the wheel dresser so that material may be removed from it during a dressing.

The feed screw 82 may be turned by either a handwheel 87, which is located on the end of the screw 83, or by an indexing unit 88 which is located immediately forwardly from the handwheel 87. The indexing unit 88 turns the shaft 83 through a predetermined angle each time it is energized, and this of course advances the slide 82 forwardly a predetermined distance that is correlated to the angle of rotation. To this end, the indexing unit 88 includes (FIG. 5) a housing 89 through which the feed screw 83 extends, and a pneumatic cylinder 90 that is mounted on the housing 89. Within the housing 89 is a rack 91 that is connected at its one end with the piston rod of the cylinder 90 such that the rack 91 will move upwardly each time the cylinder 90 is energized, and then moves downwardly again to its initial position. The distance that the rack 91 moves during its upward motion is controlled by an adjusting screw 92 that threads through the wall of the housing 89 and is located in the path of the rack 91. The gear teeth on the rack 91 engage a pinion 93 that is on the feed screw 83, it being connected to the screw 83 through a one-way clutch that is constructed such that it turns the screw 83 when the pinion 93 is rotated by the upward movement of the rack 91, but not by the downward movement. The indexing unit 88 is operated in conjunction with the wheel dresser 44 so as to advance the grinding wheel 36 a slight increment forwardly before each dressing of the wheel 36.

The slide 82 of the swing arm assembly 34 carries a bearing block 94 (FIG. 3) having bearings through which a vertical spindle 95 extends, the axis of the spindle 95 being parallel to the axis of the swing arm shaft 62. The grinding wheel 36 is secured to the upper end of the spindle 95. In addition to the bearing block 94 and its spindle 95, the slide 82 also supports an electric motor 96 that is connected to the lower end of the spindle 95 through a V-belt drive 97. Thus, when the motor 96 is energized, the grinding wheel 36 rotates about the vertical axis of the spindle 90. Since the hydraulic cylinder 76 is supplied alternately with oil at one end then the other, the rotating wheel 36 moves to and fro, its periphery tracing a swing path q that passes through the grind point p. Indeed, the feed mechanism 84 should be adjusted such that the periphery of the wheel 36 comes to precisely the grind point p, but no further.

The slide assembly 38 includes (FIG. 6) a base member 100 that is bolted firmly to the front pedestal 56 of the main frame 32 and to the upright mounting plate 50 of the base 30 generally forwardly from the grind point p. The member 100 possesses a slideway 102 that extends horizontally and from front to rear, that is perpendicular to the upright plate 50, and mounted on the slideway 102 is a horizontal slide 104 containing a nut which is engaged by a feed screw 105 on the end of a drive shaft 106 which extends through a bearing in the upright plate 50. Beyond the mounting plate 50, the horizontal feed screw 106 is coupled with the feed assembly 42 which rotates the screw 106 and thereby moves the slide 104 over its slideway 102. The horizontal slide 104, in turn, has a vertical slideway 108 and also a vertical feed screw 110.

Figure 7:
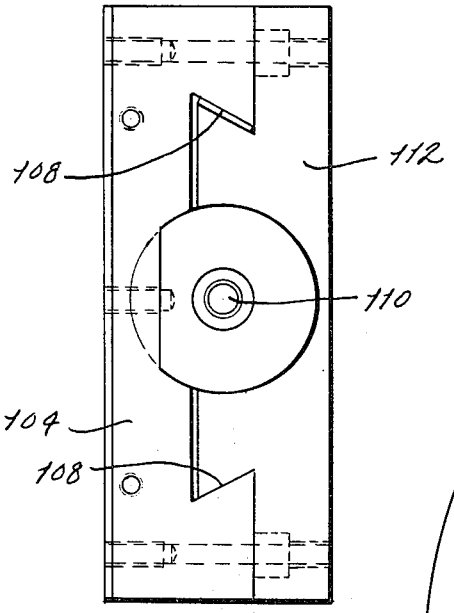
FIG. 7 is a sectional view taken along line 7—7 of FIG. 6 and showing the vertical slide.

Mounted upon the vertical slideway 108 is a vertical slide 112 (FIGS. 6 and 7) that contains a nut through which the vertical feed screw 110 is threaded. Thus, when the vertical screw 110 is turned, the slide 112 moves upwardly or downwardly, depending on the direction of rotation. The upper end of the vertical screw 110 is located opposite to the end of a drive shaft 114 that extends parallel to the other shaft 106 generally above it. The drive shaft 114 is supported in bearings located on the horizontal slide 104 and in the upright plate 50, and is coupled at its rear end to the upper end of the feed screw 110 through bevel gears 116. The drive shaft 114 at its forward end is connected with the feed assembly 42, and when turned by the feed assembly 42, it rotates the vertical screw 110 to thereby change the elevation of the vertical slide 112.

Figure 8:
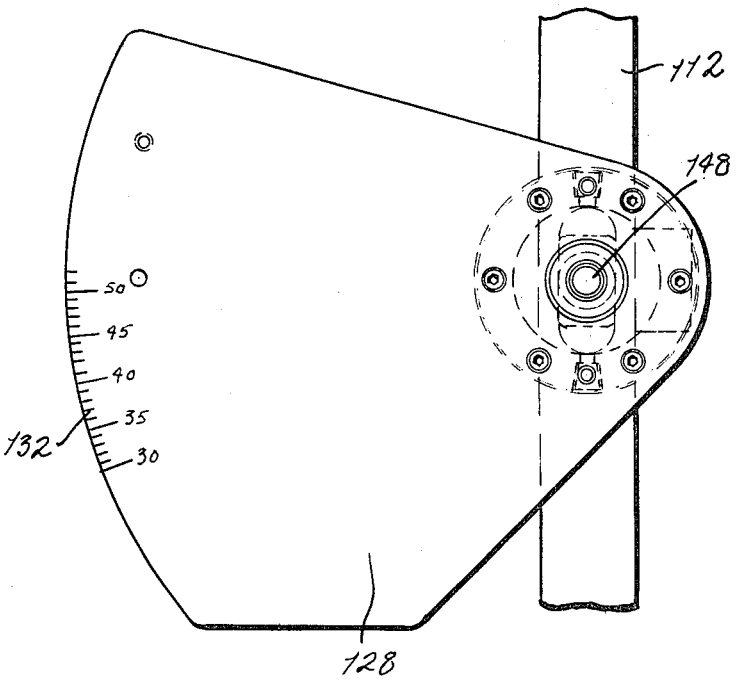
FIG. 8 is a sectional view taken along line 8—8 of FIG. 6 and showing the support plate over which the work head assembly is positioned.

At its upper end the vertical slide 112 is provided with a short pneumatic cylinder 120 (FIG. 6), the axis y of which is vertical and parallel to the axis of rotation for the grinding wheel 36. The cylinder 120 contains a bore 122 that opens upwardly and a smaller guide bore 124 at its lower end, with the two bores 122 and 124 being concentric to the vertical axis y. The cylinder 120 is further provided with ports at its lower end, and these ports are connected with hydraulic lines for supplying pressurized oil to the interior of the cylinder 120. The upper end of the bore 122 is closed by a plate 128 that is provided with a circular opening 130 which is likewise concentric to the axis y. The plate 128 projects a considerable distance beyond one side of the cylinder 120 where it terminates at an arcuate edge along which a scale 132 (FIG. 8) that is graduated in degrees is located. The bore 122 of the cylinder 120 contains a piston 134 which is provided at its lower end with a pilot 136 that fits into the reduced guide bore 124 to guide the piston 134 and thereby prevent it from skewing within the cylinder 120. The bore 122 further contains a belleville spring or washer 136 that fits between the upper end of the piston 134 and the overlying plate 128 and urges the piston 134 downwardly. Of course, when pressurized oil is introduced into the cylinder 120 through its ports, the piston 134 is forced upwardly and compresses the washer 136. The cylinder 120 and the support plate 128 which is fastened to it provide a mount upon which the work head assembly 40 is positioned.

The cover 46 fits over the base 30 and encloses the main frame 32, the swing arm assembly 34, the grinding wheel 36, the slide assembly 38, and the wheel dresser 44. In this regard, the cover 46 includes (FIG. 2) a horizontal surface 141 that attaches to the upper edge of the upstanding plate 50 of the base 30 and extends rearwardly therefrom, overlying the main frame 32, the swing arm assembly 34, and the slide assembly 38.

While a portion of the surface 141 is exposed at the front of the cover 46, most of it is obscured within a housing 142 that projects upwardly from the surface 141 and has a hinged lid 143 that swings upwardly to expose the grinding wheel 36 and the wheel dresser 44 that are enclosed within the housing 142. Indeed, the portion of the horizontal surface 144 which is located within the housing 142 contains a large arcuate aperture 144 which accomodates the swing of the spindle 90 on which the grinding wheel 36 is mounted. This portion of the horizontal surface 141 is also cut away to accommodate the mounting plate 54 of the base 30. The exposed or forward portion of the horizontal surface 141, on the other hand, has an aperture 145 through which the pneumatic cylinder 120 of the vertical slide 112 projects.

The work head assembly 40 is mounted upon the plate 128 of the vertical slide 112 such that it can be rotated to the desired position about the vertical axis y and then clamped securely in that position. It includes a base plate 146 (FIG. 6) that rests upon the plate 128 of the slide 112, extending outwardly to the scale 132 where it is provided with a reference mark that locates opposite to the scale 132. The base plate 146 is further provided with a circular aperture 147 that aligns with the circular opening 130 in the plate 128 of the slide 112, and extending through the aligned aperture 147 and opening 130 is a pivot pin 148 that is attached to the top of the piston 134 in the cylinder 120 by a bolt 149. At its upper end the pin 148 has a flange 150 that overlies the top surface of the base plate 140, the length of the pin 148 being such that when the flange 150 is against the base plate, the belleville washer 138 within the cylinder 120 is compressed. This holds the base plate 146 as well as the entire work head assembly 40 firmly against support plate 128 on the vertical slide 112. However, when the cylinder 120 is pressurized, the piston 134 moves upwardly and elevates the pivot pin 148, thereby freeing the base plate 146 to enable the entire work head assembly 40 to pivot about the vertical axis y.

Projecting upwardly from the base plate 146 is a vertical plate 151 (FIGS. 6 and 9) on which a horizontal pivot pin 152 is mounted, the axis z of the pin 152 being perpendicular to and intersecting the axis y of the vertical pivot pin 148. The forwardly presented edge of the vertical plate 151 is concentric with respect to the axis z, and along this edge is a scale 154 that is likewise graduated in angular degrees. Set inwardly from the scale 154 are two arcuate slots 156 which are also concentric about the axis z.

The vertical plate 150 carries a head 160 which includes a tubular forward portion 162 (FIG. 9) and a pivot arm 164 that extends axially from the rear end of the tubular portion 162. Indeed, the arm 164 is fitted to the horizontal pivot pin 152 so that the head 160 can pivot upwardly and downwardly about the axis z. Along the rear of the arm 164, the head 160 is provided with a reference marker 166 that locates along the scale 154 of the plate 150 to indicate the inclination of the head 160. Once the head 160 is in the desired angular position, it may be clamped in that position by turning down bolts 168 which pass through the arcuate slots 156 and thread into both the tubular portion 162 and the arm 164. The tubular portion 162 for the most part projects forwardly beyond the vertical plate 150 and its hollow interior opens both forwardly toward the operator of the machine A and rearwardly toward the axis z of the pin 152. Indeed, the axis x of the tubular portion 162 if projected forwardly will pass through the point of intersection for the axes y and z of the vertical pivot pin 148 and the horizontal pivot pin 152, respectively.

The tubular portion 162 of the head 160 contains a pair of angular ball bearings 169 (FIG. 9) that are mounted concentric to the axis x, and these bearings support a collet chuck 170, enabling the chuck 170 to rotate within the head 160. Indeed, the bearings 169 are adjusted to a condition of slight preload so that the chuck 170 does not possess any end or radial play insofar as the head 160 is concerned. The chuck 170 has bore 171 that is somewhat larger than the diameter of the tool holder that holds the end mill blank B and is further concentric to the axis x. The rear end of the bore 171 is lined with gripping elements 172 that have beveled back faces which lie along backing surfaces of corresponding bevel. At its forward end the chuck 170 has a drive collar 173, the bore 171 of which is of constant diameter which is generally the same diameter as the portion of the bore 171 that is lined by the gripping elements 172. The drive collar 173 has an annular cavity 174 which opens rearwardly and communicates with a port in the tubular portion 162 of the head 160. The cavity 174 contains an annular piston 175 that bears against the ends of the gripping elements 172. Thus, when the cavity 174 is pressurized, the piston 175 is forced axially against the ends of the gripping elements 172, causing the beveled surfaces in the gripping elements 172 to move along the beveled backing surface. As a consequence the gripping elements 172 contract and reduce the diameter of the bore 171.

Figure 10:
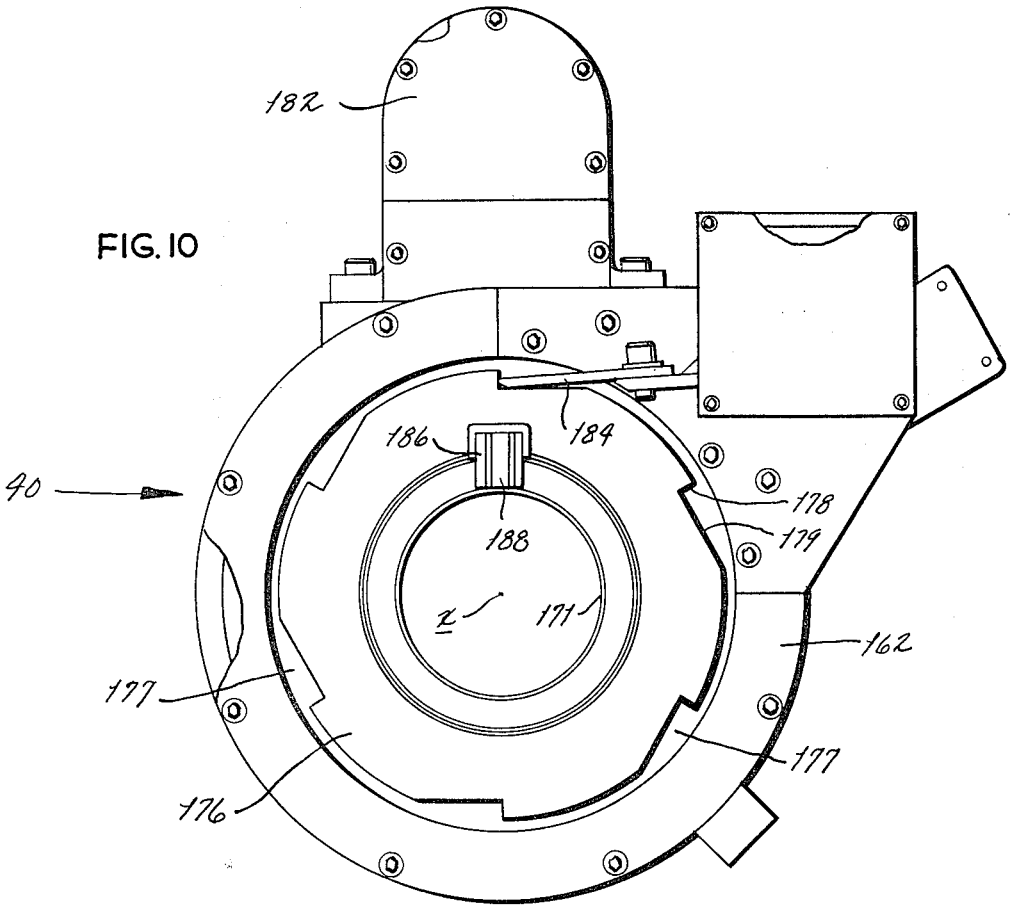
FIG. 10 is an end elevational view of the work head assembly taken along line 10—10 of FIG. 6.

At its forward end the drive collar 173 is fitted with an indexing ring 176 (FIG. 10) having notches 177 spaced at equal intervals around its periphery, the notches 177 corresponding in number to the gashes 12 which are to be ground into the end mill blank B. Each notch 177 possesses a radial edge 178 and a longer trainling edge 179 that leads away from the radial edge 178 at a right angle with respect to it.

Intermediate its ends the chuck 170 is fitted with a gear ring 180 (FIG. 9), and the teeth on this ring are engaged by a pinion gear on a hydraulic drive motor 182 (FIGS. 6 and 10) which is mounted upon the tubular portion 162 of the bevel 160. The motor 182 is designed to rotate the collet chuck 170 in both directions, but primarily in the direction in which the radial edge 178 of the indexing ring 176 leads.

Both the notches 177 and the motor 182 cooperate with a spring loaded locating finger 184 (FIG. 10) to index the chuck 170 such that it advances or rotates in equal angular increments. More specifically, the finger 184 is mounted upon the tubular portion 162 of the head 160 and is aligned generally with the peripheral edge of the indexing ring 172 such that it bears against that edge along one of its faces and will drop downwardly into a notch 177 when one passes beneath it. Indeed, when the finger 184 is within a notch 177, it lies generally along the trailing edge 179. Moreover, its fulcrum is located beyond the end of the edge 179 and generally in alignment with it. The end of the finger 184 abuts the radial edge 176 of the notch 174, enabling the finger 184 to precisely position the chuck 170.

In order to index the chuck 170, the motor 182 is energized just long enough to bring the next notch 177 of the indexing ring 176 beneath the locating finger 184, which thereupon drops into that notch. Then the motor 182 is reversed, and this causes the ring 180 to rotate backwardly until the end of the finger 184 bears against the radial edge 178 of the notch 179.

In addition to the indexing ring 176 and the gear ring 182, the collet chuck 170 is further fitted with tool coordinate locator 186 (FIGS. 6 and 10) that is bolted against the indexing ring 176 and has a slot 188 which opens forwardly toward the operator of the machine A.

The bore 171 of the chuck 170 is sized to easily receive a tool holder 190 (FIG. 6) having a radially directed locating pin 192 that fits snugly into the slot 199 in the coordinate locator 186. This, of course, serves to locate the holder 190 in a predetermined position, both axially and angularly, with regard to the collet chuck 170. The tool holder 190 contains a bore 194 that is concentric to the axis x when the holder 190 is in the chuck 170, and this bore is sized to snugly receive the shank 2 of an end mill blank B. The holder 190 further has a set screw 196 which is directed toward the bore 194. When the blank B is inserted into the bore 194 and properly positioned thereon, the set screw 196 may be turned down tightly against the shank 2 of the blank B to secure the blank B in the predetermined position within the holder 190.

A setting fixture (not shown) may be used to install the end mill blank B in the proper position within the tool holder 190, that is with the end face 6 of the blank B spaced at the proper distance from the locating pin 194 and the flutes 8 located in the proper angular relation to the pin 194. When the blank B is so positioned within the holder 190, and the holder 190 is in turn inserted fully into the bore 171 for the chuck 170, the center of the end face 6 will locate precisely at the intersection of three axes x, y, and z.

Figure 11:
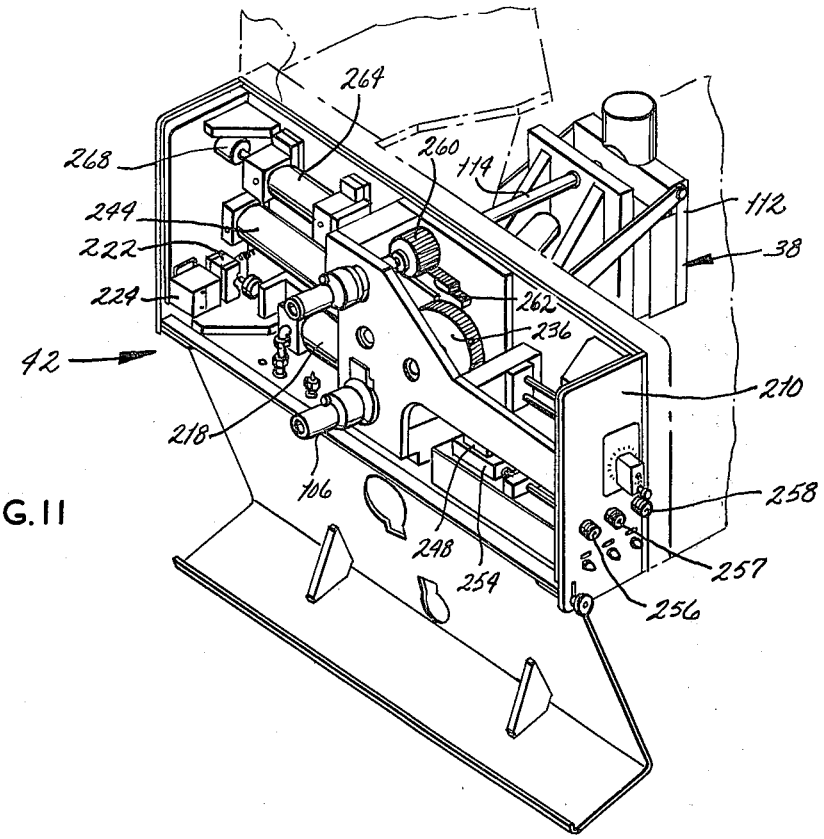
FIG. 11 is a perspective view of the feed assembly.

Turning now to the feed assembly 42 (FIGS. 2 & 11), it is located opposite the forward face of the upright plate 50 on the base 30 and is enclosed within a housing 210 that is supported on the plate 50. The feed assembly 42, among other functions, controls the positions of the horizontal slide 104 and the vertical slide 112 by rotating their respective drive shafts 106 and 114. To this end both of the drive shafts 106 and 114, project through the upright plate 50 as well as through the housing 21, beyond which they are provided with knobs so that they may be gripped and turned to manually advance or retract the slides 104 and 112.

Figure 13:
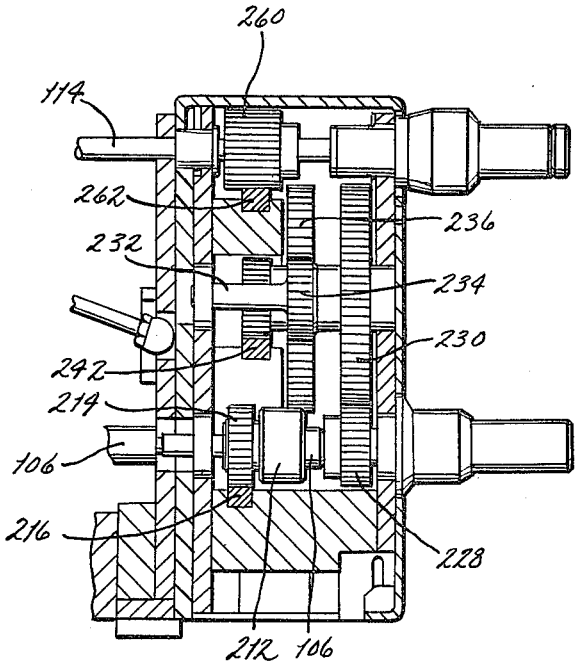
FIG. 13 is a sectional view of the feed assembly taken along line 13—13 of FIG. 11.
Figure 14:
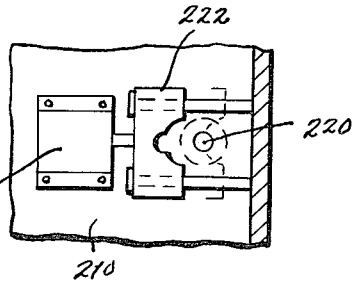
FIG. 14 is a sectional view taken along line 14—14 of FIG. 12 and showing the supplemental stop and the solenoid that controls it.

Considering first the means for rotating the drive shaft 106 to thereby advance the horizontal slide 104 inwardly, the horizontal drive shaft 106 is fitted with a sprague-type clutch 212 (FIG. 13) that is provided with a pinion gear 214 through which it is driven, the clutch 212 being such that it will rotate the shaft 106 clockwise when the gear 214 is turned in that direction, but will disengage the shaft 106 and leave it at rest when the gear 214 is turned counterclockwise. The pinion gear 214 meshes with a rack 216 which moves horizontally beneath it. The rack 216 is connected directly to the piston rod of a double acting pneumatic cylinder 218 (FIG. 12), the barrel of which is mounted firmly upon the upstanding plate 50 of the base 30. Thus, each time the cylinder 218 moves the rack 216 to the left, the drive shaft 106 rotates and advances the horizontal slide 104. On the other hand, when the cylinder 218 moves the rack 216 to the right, the shaft 106 and horizontal slide 104 merely remain at rest. The piston rod of the cylinder 218 extends in both directions beyond the barrel and on the side opposite from the rack 216 it aligns with the end of a stop screw 220 that is threaded into the side wall of the housing 210. The screw 220 determines the distance that the rack 216 will advance each time that the cylinder 218 is energized. Actually the stop screw 220 controls only the rough feed of the horizontal slide 104, there being a supplemental stop 222 (FIGS. 11, 12, & 14) positioned on a solenoid 224 adjacent to the stop screw 220 to control fine feed. When the solenoid 224 is energized, the supplemental stop 222 moves between the stop screw 220 and the end of the piston rod for the cylinder 218 and accordingly prevents the rack 116 from advancing as far as would otherwise be the case. Hence, the drive shaft 106 rotates through a lesser angle. Of course, each time the horizontal slide 104 moves inwardly, it places the end of the end mill blank B further into the swing path q of the grinding wheel 36 as it swings to and fro about the grind point p, thereby producing a gash 12, or at least the beginning of a gash 12, within the end mill blank B.

Not only does the pneumatic cylinder 218 advance the horizontal slide 104 and the work head assembly 40 each time that it is energized, but it further advances a control slide 226 (FIG. 12) that is located within the housing 210 and forms part of the feed assembly 42. The control slide 226 in turn, causes the wheel dresser 44 and the solenoid 224 for the supplemental stop 222 to be energized in the proper sequence, and further brings the grind cycle to a termination at the proper time so that the various components of the machine A may be returned to their initial positions.

The drive shaft 106 and the control slide 226 are connected through back gearing that consists of a pinion gear 228 (FIGS. 12 and 13) which is mounted on the shaft 106 rearwardly from the clutch 212. The pinion gear 228 meshes with a spur gear 230 that is mounted on an idler shaft 232 located directly above and parallel to the drive shaft 106. The idler shaft 232 in turn carries a pinion gear 234 that meshes with a spur gear 236 on another idler shaft 238 which is located to the side of and parallel to the shaft 232. The other idler shaft 236 has a pinion gear 240 that meshes with a rack 242 that moves horizontally through the housing 210 above the rack 216. Thus, each time pinion gear 214 on the clutch 212 is rotated clockwise, the rack 242 shifts to the left. The advance of the rack 242 to the left is, of course, incremental, and the extent of each incremental advance depends on whether or not the piston rod of the cylinder 218 encounters the stop screw 220 or the supplemental stop 224.

Figure 12:
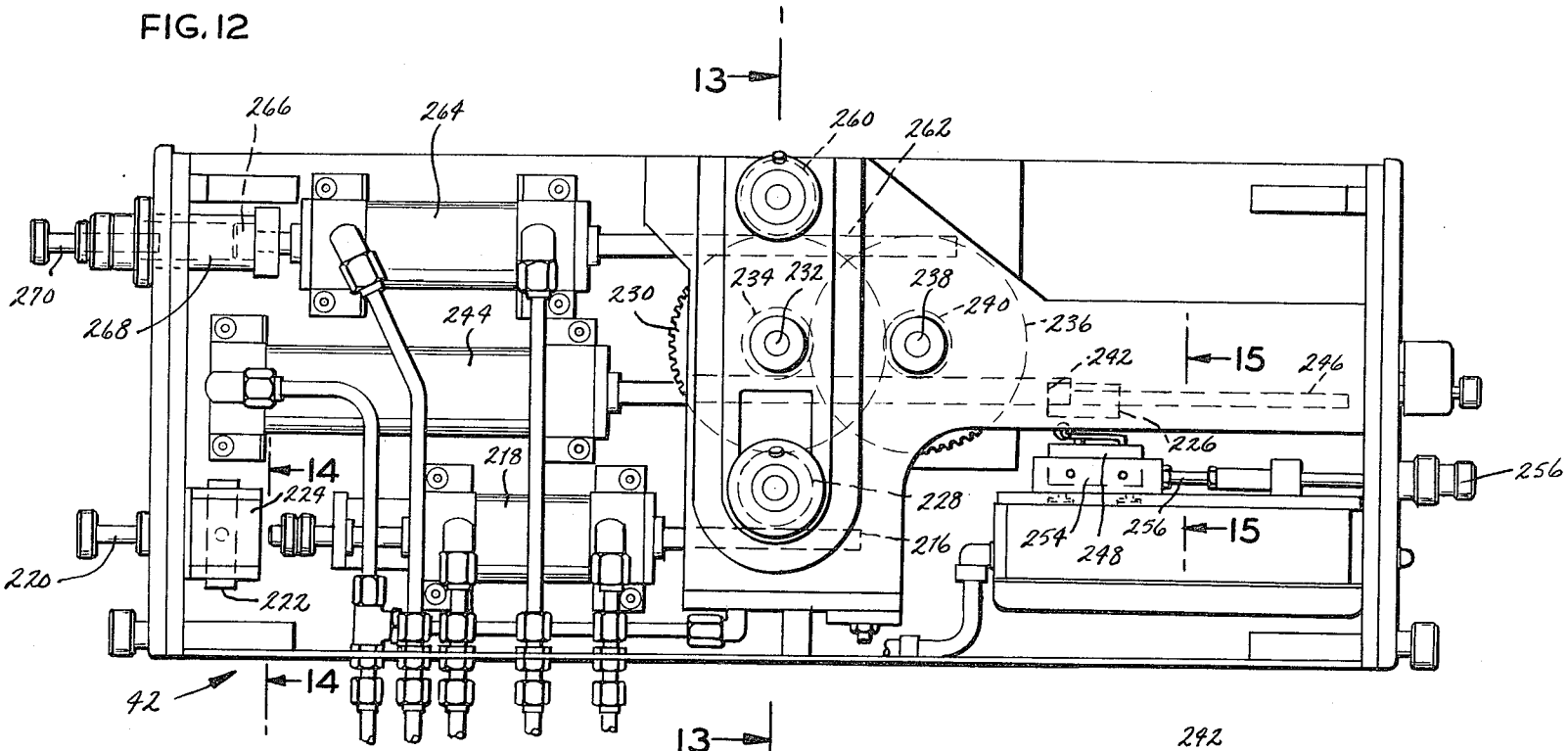
FIG. 12 is a front elevational view of the feed assembly.
Figure 15:
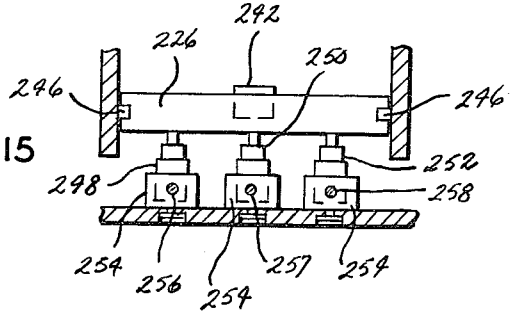
FIG. 15 is a sectional view taken along line 15—15 of FIG. 12 and showing the control slide and the switches that it operates.

One end of the control rack 242 is connected with the piston rod of a single acting pneumatic cylinder 244 (FIG. 12) that is also mounted on the upright plate 50 of the base 30, the arrangement being such that each incremental advance of the rack 242 to the left pushes the piston rod of the cylinder 244 further into the barrel for that cylinder. The cylinder 244 when energized drives the rack 242 to the right and through the back gearing rotates the horizontal drive shaft 106 counterclockwise to return the horizontal slide 104 to its initial position. The opposite end of the rack 242 is connected to the control slide 226 which moves along horizontal ways 246 and in so doing passes by three control switches 248, 250, and 252 (FIGS. 12 & 15). Each switch 248, 250 and 252 is mounted on a separate support block 252 and has an actuator that projects into the path of the control slide 226. The block 254 for the switch 248 is connected with and positioned by a screw 256, that is turned by a knob at the end of the housing 210; the block 254 for the switch 250 is positioned by a screw 257; and the block 254 for the switch 252 is positioned by a screw 258. Thus, the positions at which the switches 248, 250, and 252 are actuated can be varied by rotating the respective screws 256, 257 and 258.

Turning now to the other drive shaft 114, which moves the vertical slide 112, that shaft is provided with a pinion gear 260 (FIGS. 11–13) that meshes with a rack 262 which moves horizontally beneath the shaft 114 and the gear 260. The arrangement is such that when the rack 262 moves to the left and rotates the drive shaft 114 clockwise, the vertical slide 112 moves downwardly, bringing the work head assembly 40 with it. This causes the grinding wheel 36 to grind off of the heel face 16 of the gash 12 instead of off both the rake face 14 and heel face 16. The rack 262 is coupled to the end of the piston rod for a pneumatic cylinder 264 that is mounted on the upright plate 50 of the base 30 above the cylinder 244 for the control slide 226. The opposite end of the piston rod projects beyond the end of the barrel for the cylinder 264 where it is provided with an enlarged head 266 which moves in a guide sleeve 268. When fully extended, the head 266 abuts the end of a stop screw 270 that threads into one end of the sleeve 268. Thus, the screw 270 determines the distance that the rack 262 moves and that distance can be adjusted by turning the screw 270. The cylinder 264, being double acting, also moves the rack 262 back to its initial position, and of course, the vertical slide 112 to its zero position. Indeed, the initial position is reached when the head 266 bottoms out against the end of the sleeve 268 in which it moves.

Referring now to the three switches 248, 250, and 252 that are located below the control slide 226 and are actuated by it, the first switch 248, that is the one which is first actuated by the slide 226, provides an electrical signal which sets the wheel dresser 44 in operation and further energizes the solenoid 224 so as to place the supplemental stop 222 in the path of the piston rod for the hydraulic cylinder 218. Thus, the switch 248 initiates the shift from rough feed to fine feed insofar as the horizontal slide 104 is concerned.

The second switch 250, which is the next to be actuated, provides a signal which energizes the pneumatic cylinder 264, and causes it to lower the vertical slide 112. As a consequence, the grinding wheel 36 thereafter grinds only off of the heel face 16 of the gash 12, leaving the rake face 14 unaltered. In addition, the signal sets the hydraulic motor 182 on the work head assembly 40 into a skip tooth phase wherein the motor 182, each time that it rotates the collet chuck 170, turns that chuck 180°. This enables two of the gashes 12 to be ground to the very center of the blank B.

The third switch 152, which is the last to be actuated, provides a signal which terminates the grind cycle and returns the various components of the grinding machine to their initial or start positions.

The wheel dresser 44 is positioned upon mounting plate 54 of the base 30 and is normally enclosed by the housing 142 of the cover 46, although access to the dresser 44 can be obtained by lifting the hinged lid 143. The dresser 44 serves to dress the grinding wheel 36 between the rough grind and the fine grind positions of the cycle so as to provide the wheel 361 with a profile that will provide the desired bottom gash angle t. The dresser 44 is set in operation by the switch 248 that brings the supplemental stop 222 into an operation position.

Figure 16:
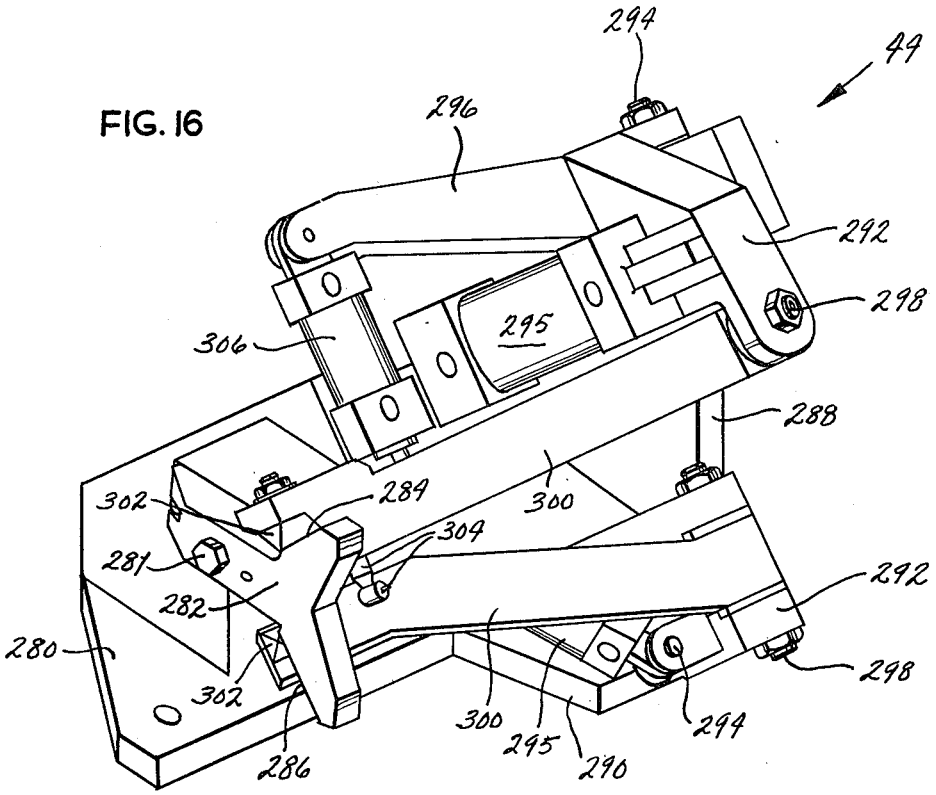
FIG. 16 is a perspective view of the wheel dresser.

The wheel dresser 44 includes a base frame 280 (FIG. 16) that is bolted firmly to the mounting plate 54 of the main base 30 generally to the side of the grind point p. Attached to one end of the base frame 280 by a bolt 281 is a cam 282 having upper and lower camming surfaces 284 and 286 which control the profile of the grinding wheel 36. Normally different end mills require different bottom gash angles t and require wheels 36 of different profile, and accordingly, the cam 282 should correspond to the profile of the wheel 36 that is being used. The cam 282, being bolted in place, may be removed and replaced with a cam 282 configured to provide a different profile. At its opposite end the base frame 280 has an upwardly directed leg 288 and a laterally directed leg 290, the latter of which projects generally toward the swing arm assembly 34.

Considering first the upwardly directed leg 288, it has an upper arm mount 292 attached to it by means of a pivot pin 294, the axis of which is oblique and roughly perpendicular to the upper of the two beveled surfaces on the wheel 36 that is to be dressed. Thus, the upper arm mount 292 pivots about the axis of the pin 294, this movement being provided by a double acting feed cylinder 295 that extends between the mount 292 and the base frame. In addition, the arm mount 292 has a backing arm 296 that projects away from the axis of the pivot pin 294. The upper arm mount 292 also has another pivot pin 298 which is oriented at a right angle to the pin 294, and this pin serves as a pivot for a dressing arm 300 that extends toward the cam 282 generally beneath the backing arm 296. Indeed, the dressing arm 300 carries a follower 302 that bears against and rides over the upper camming surface 288 of the cam 282. The dressing arm 300 also carries a dressing element in the form of a diamond 304 which is presented toward that surface of the wheel 36 that is to be dressed. Fitted between the backing arm 296 and the dressing arm 300 is a pneumatic pressure cylinder 306 which urges the dressing arm 300 generally downwardly and toward the dressing wheel 36. During the dressing operation, the cylinder 306 serves to both hold the diamond 304 against the grinding wheel 36 and the cam follower 302 against the camming surface 288.

The laterally directed leg 290 of the base frame 280 carries a similar arrangement, only that arrangement is oriented differently to dress the lower of the two beveled surfaces for the wheel 36. In particular, the laterally directed leg 290 supports a lower arm mount 292 which pivots about a pin 294 under the force exerted by a feed cylinder 295. A lower dressing arm 300 extends from the lower arm mount 292 and pivots thereon about a pivot pin 298. The lower arm 300 carries a follower 302 that rides over the lower camming surface 286 on the cam 282 and a diamond 304 that actually dresses the lower grinding surface of the wheel 36. A pressure cylinder 306 keeps the follower 302 against the camming surface 286 and the diamond 304 against the wheel 86.

When the control slide 246 of the feed assembly 42 contacts and operates the switch 248, the cylinder 76 for the swing arm 70 moves the arm 70 to the left whereas the other cylinder 86 urges the slide 82 forwardly toward the wheel dresser 44 to eliminate all lost motion in the feed screw 83. Then, the two feed cylinders 295 of the dresser 44 are energized, and they move their respective arm mounts 292 and the dressing arms 300 that are carried on those mounts. As a consequence, the cam followers 302 move over the camming surfaces 284 and 286 on the cam 282, causing the diamonds 304 to follow a predetermined path which corresponds to the desired profile for the wheel 36. Indeed, the diamonds 304 move over the grinding wheel 36 and provide it with the desired profile.

The grinding machine A has a control console 310 (FIG. 1) that is located above the exposed portion of the horizontal surface 141 on the cover 46 where it is easily accessible to an operator standing in front of the machine A. The console 310 has various switches including one for starting the grind cycle, one for energizing the wheel dresser to dress a new wheel 36, another for accommodating the machine A to the number of flutes 8 in the tool blank B that is to be gashed, still another for energizing the cylinder 120 to release the work head assembly 40 so that it can be repositioned about its vertical axis y, and yet another for pressurizing the annular cavity 174 of the collet chuck 170 to enable the chuck 170 to tightly grip the tool holder 190.

In addition, the machine A is provided with a control and powder unit 316 (FIG. 1) that receives signals from the control console 310 as well as from the switches 248, 250, and 252 of the feed assembly 42, and in response to these signals directs pressurized fluid, whether it be hydraulic fluid or air, to the cylinders 76, 86, 120, 218, 244, 264, 295 and 306, as well as to the motor 182 and collet chuck 170 of the work head assembly 42, all in the proper sequence.

Finally, the machine A has a coolant system which terminates at nozzles (not shown) that are directed at the grind point p from both above and below the grinding wheel 36. These nozzles are located within the upper portion of cover 46 where the coolant discharged from them is collected so that it can be recirculated.

OPERATION

To prepare the machine A for operation, the operator first selects the proper cam 282 for the wheel dresser 44 and installs that cam on the base frame 280 of the dresser 44, turning down the bolt 281 to secure that the cam 282 firmly in place. In this regard, different end mills have their rake and heel faces 14 and 16 at different bottom gash angles t and the particular angle t is determined solely by the profile of the grinding wheel 36. The grinding wheel 36, in turn, must be dressed from time to time to ensure that its profile remains appropriate for the end mill blank B which is to be ground.

Of course, in addition to selecting the proper cam for the wheel dresser 44, the operator must select the appropriate grinding wheel 36 to ensure that the thickness and profile of that wheel are appropriate for the particular end mill blank B which is to be ground. Once the wheel 36 is installed on the spindle 90 of the swing arm assembly 34, the swing arm assembly 34, by operating an appropriate switch on the control console 310, is moved to bring the grinding wheel 36 to its dress position. More specifically, the cylinder 76 moves the arm 70 to the left end of the swing path q and the cylinder 86 urges the slide 82 forwardly. Thereupon, the feed cylinders 295 of the wheel dresser 44 are automatically energized in sequence along with their corresponding pressure cylinders 306, and the diamonds 304 pass over the upper and lower grinding surfaces of the wheel 36 to ensure that those surfaces possess the proper contour and angles.

Aside from initially dressing the grinding wheel 36, the work head assembly 40 is adjusted to provide the appropriate rake angle r and the gash angle s. These angles vary from one type of end mill to another and specifications are provided listing the angles for each type of end mill. The gash angle s is controlled by the angular position of the work head assembly 40 relative to the vertical axis y which passes through the vertical pivot pin 148 on which the support plate 128 of the work head assembly 40 is positioned. To free the work head assembly 40 so that it will pivot about the pin 44, the appropriate switch on the control console 210 is operated to introduce pressurized fluid into the hydraulic cylinder 120 on the vertical slide 112. This elevates the pivot pin 148 and in so doing overcomes the downwardly directed force exerted on the piston 134 by the belleville washer 138. The work head assembly 40 is then rotated until the reference mark 146 on its base plate 146 aligns with the appropriate angle on the scale 132 that extends along the edge of the support plate 128 of the vertical slide 112. When the work head assembly 40 is at the proper angle along the scale 132, the switch on the control console 210 is operated to release the pressure within the hydraulic cylinder 120, whereupon the belleville washer 138 forces the flange 150 of the vertical pivot pin 148 downwardly against the base plate 146 and thereby clamps the base plate 146 to the support plate 128, securing the work head assembly 40 firmly to the vertical slide 112.

The position of the head 160 about the horizontal axis z of the piviot pin 152 establishes the rake angle r. In order to acquire the proper rake angle r, the bolts 168 which pass through the arcuate slots 156 in the vertical plate 150 and thread into the head 160 are loosened to free the head 160 so that it can pivot upwardly and downwardly about the horizontal axis z of the pin 152. The head 160 is moved until the reference mark 166 upon it aligns with the appropriate angle on the scale 154 that is located along the arcuate edge of the vertical plate 150. Thereupon, the bolts 168 are tightened down to secure the head 160 in the proper position.

Next, the appropriate indexing ring 176 is selected, and this ring must have notches 177 which correspond in number to the flutes 8 on the end mill blank B that is scheduled for gashing. The indexing ring 176 is bolted against the forward end of the drive collar 173 on the collet chuck 170 of the work head assembly 40.

Aside from the foregoing, the switches 248, 250 and 252 within the feed assembly 42 must be set so that they are actuated at the appropriate times during the grinding cycle. First of all the cycle complete switch 252 is set so that it will be tripped when the control slide 226 advances a known distance beyond its initial or zero position, and this distance varies from one size or type of end mill to another. To set the switch 252, the horizontal slide 104 is moved inwardly by manually manipulating the exposed end of the horizontal drive shaft 106 until the micrometer scale on the shaft 106 indicates that the slide 104 has reached the desired position. Then the screw 258 that controls the position of the block 254 on which the switch 252 is mounted is turned until the actuator for the switch 252 is depressed sufficiently to change the condition of the switch 252. Next, the control slide 226 is backed off to the position in which the split-to-center switch 250 is to be energized, and this is usually about 0.130 inches. Then the switch 250 is moved with its screw 257 until its condition is changed. Next, the control slide 104 is backed off a short distance further, usually about 0.100 inches, and the screw 256 for the dress switch 248 is turned until the condition of switch changes.

After setting the switches 248, 250 and 252, the stop screws 220 and 270 for the pneumatic cylinders 218 and 264 are turned until their ends are located the proper distances beyond their respective pneumatic cylinders 218 and 264. The screw 220 controls the travel of the piston rod for cylinder 218 which is the distance the rack 216 moves, and of course this distance is directly correlated with the incremental advances of the horizontal slide 104 during the rough feeding portion of the grind cycle. On the other hand, the adjusting screw 270 controls the distance the piston rod of the pneumatic cylinder 264 travels, which is the distance that the rack 262 moves, and that distance is directly correlated to the downward shift of the vertical slide 112 when the split-to-center switch 250 is actuated.

Once the machine A is set up in the foregoing manner, the end mill blank B is loaded into the tool holder 190 (FIG. 6) using a setting fixture (not shown) to precisely position the blank with respect to the holder 190. In this regard, both the distance of the end face 6 from the locating pin 194 and the angular relationship between the forward ends of the flutes 8 and the locating pin 194 are critical. The setting fixture insures that the proper axial spacing and angular relationship exists. Once the blank B is properly positioned in the holder 190, the set screw 196 of the holder 190 is turned down to secure the blank B firmly within the holder 190. Then the operator inserts the tool holder 190 into the collet chuck 170 of the work head assembly 40, rotating it such that the locating pin 194 of the holder 190 fits into the forwardly opening slot 88 of the coordinate locator 186. When the tool holder 190 is so positioned, the axis k of the blank B will lie coincident to the axis x of the collet chuck 170, and the center of the end face 6 on the blank will be precisely at the intersection of the axes x, y and z for the work head assembly 40.

Assuming that the machine A is set at the zero position, that is the position in which the vertical and horizontal slides 104 and 112 are in their initial or zero positions, the center of the end face 6 on the end mill blank B will locate precisely at the grind point p, and the swing path q described by the grinding wheel 36 will pass immediately ahead of the location where one of the flutes 8 opens out of the end face 6. The machine A is thereupon energized and automatically grinds the appropriate number of gashes 12 into the end face 6 of the mill blank B and furthermore cuts two of those gashes 12 to the very center of the end face 6 so that they are split-to-center, so to speak. Upon completion of the automatic grind cycle, the tool holder 190 is removed from the work head assembly 40 so that it can be replaced by another tool holder 190 that contains the next end mill blank B.

The grind cycle commences with the pressurization of the annular cavity 174 in the collet chuck 170. This drives the piston 175 toward the gripping elements 172, causing the elements 172 to tightly grasp the tool holder 190 and thereby hold the end mill blank B firmly in the work head assembly 40. Also, the hydraulic cylinder 76 is alternately pressurized from each of its ends, so as to swing the grinding wheel back and forth. The periphery of the revolving wheel 36 of course moves along the swing path q and through the grind point p starting a cut or gash 12 in the end of the blank B. With each swing of the wheel 36 past the end face 6 of the blank B and return to its initial position, the control unit energizes the hydraulic motor 182 on the work head assembly 40 causing that motor 184 to rotate the drive collar 173 a distance slightly greater than the angular spacing between the flutes 8 on the blank. This enables the locating finger 184 to move out of one notch 177 and drop into the succeeding notch 177, and when this occurs, the motor 182 reverses and rotates the drive collar 173 in the opposite direction until the radial edge 178 of the succeeding notch 177 is against the end edge of the locating finger 184. This insures that the advance of the collet chuck 170 corresponds precisely to the angular spacing between the flutes 8, and as a consequence, the swing path q of the grinding wheel 36 now is located immediately in front of the next flute 8 upon the end mill blank B. Thereupon, the cylinder 76 again moves the grinding wheel 36 past the end face of the blank B. The same procedure is repeated for the number of flutes 8 within the end mill blank B.

When the number of cuts equals the number of flutes 8 in the end mill blank B, that is when the indexing ring 176 has revolved 360°, and the swing arm 70 has returned to its initial position, the control unit 312 energizes the pneumatic cylinder 218 of the feed mechanism 42 and this causes the piston of the cylinder 218 to shift to the left until it contacts the stop screw 220. The rack 216 likewise moves to the left and turns the pinion gear 214, which operating through the clutch 212 rotates the drive shaft 106. Since the drive shaft 106 is connected with the horizontal feed screw 105, the feed screw 105 likewise rotates and moves the horizontal slide 104 inwardly the distance prescribed for the rough feed. Thereupon, the swing arm 70 again moves the grinding wheel 36 back and forth along its swing path q with the motor 182 indexing the chuck 170 and the blank B between each complete swing. As a consequence, the grinding wheel 36 grinds deeper into the cuts in the end face 6 of the end mill blank B so that the cuts begin to assume the configuration of the desired gashes 12.

The foregoing procedure continues automatically until the control slide 226 actuates the dress switch 248. By this time cuts of significant depth appear in the end of the end mill blank B.

Once the dress switch 248 is tripped, the control unit energizes the pneumatic cylinder 86 to thrust the grinding wheel forwardly toward the wheel dresser 44. Also the two feed cylinders 295 and pressure cylinders 306 of the dresser 44 are energized so as to dress the wheel 36 prior to the commencement of the fine feed advance. In addition, the automatic dress switch causes the solenoid 224 to place the supplemental stop 222 opposite the end of the piston rod for the pneumatic cylinder 218. Thereupon, the cylinder 218 is again pressurized, but by reason of the presence of the supplemental stop 222 in the path of the rod for the cylinder 218, the stroke of the cylinder 218 and the movement of the rack 216 are considerably less. As a consequence, the advance of the horizontal slide 104 toward that path q of the grinding wheel 36 is of considerably less magnitude than the advance during the rough feed portion of the cycle. The grinding wheel 36 continues to swing left and right each time that the work head assembly 40 indexes the end mill blank B so that the wheel 36 continues to grind the cuts deeper into the blank B. However, each grind is of a lesser magnitude and is further done with a dressed wheel 36 so as to insure that the gashes 12 which are eventually produced have the appropriate configuration.

In time, the control slide actuates the split-to-center switch 250 which causes the motor 182 to turn the collet chuck 170 180° each time that it is energized. As a consequence, only two of the cuts on opposite sides of the end mill blank B are ground as the horizontal slide 104 continues to advance through the fine feed portion of cycle. Moreover, the split-to-center switch 250, when actuated, energizes the cylinder 264 which turns the drive shaft 114, which in turn rotates the vertical feed screw 110, causing it to lower the work head assembly 40. As a consequence, the grinding wheel 36 grinds only off of the heel faces 16 of the two cuts or gashes 12 which are split-to-center so to speak.

The fine feed advance of the horizontal slide 104 continues until the cycle complete switch 252 is actuated by the control slide 226, and that should occur when the gashes 12 for the two teeth on which the grinding continues meet at the center of the end mill blank B, that is, at the axis k.

Thereupon the horizontal and vertical slides 104 and 112 are automatically returned to their initial positions. Insofar as the horizontal slide 104 is concerned, this is achieved by energizing the pneumatic cylinder 244 which drives the rack 242 and control slide to the right and through the back gearing turns the horizontal drive shaft 106 which moves the horizontal slide back to its start position. The vertical slide 112 is returned merely by directing air to the opposite end of the pneumatic cylinder 264 which turns the drive shaft 114 that in turn rotates the vertical feed screw 110.

This invention is intended to cover all changes and modifications of the example of the invention herein chosen for purposes of the disclosure which do not constitute departures from the spirit and scope of the invention.

What is claimed is:

1. A machine for grinding gashes into the end of a cutting tool blank, said machine comprising: a base; a grinding wheel supported on the base; means for moving the grinding wheel such that its periphery describes a path which passes through a grind point that is fixed in position with respect to the base; a work head on the base for holding a cutting tool blank such that the end surface thereof, out of which gashes are to open, is presented at the grind point, the work head being capable of rotating the cutting tool blank about the axis of the blank to place different portions of the end surface on the blank opposite the path of the grinding wheel; and feed means for changing the distance between the work head and the grinding wheel so as to enable the grinding wheel to cut into the blank as the grinding wheel moves through the grind point of its path and for further effecting a shift in the relative positions of the grinding wheel and the work head, with that shift being parallel to the axis of rotation for the grinding wheel, the feed means comprising a first slide mounted upon the base and being adapted to move toward and away from the axis of rotation for the grinding wheel, a second slide mounted upon the first slide and being adapted to move parallel to the axis of rotation for the grinding wheel, the work head being mounted upon the second slide, a first feed screw threaded into the second slide, first and second drive shafts coupled with the first and second feed screws, respectively, such that when the first shaft is rotated, the first feed screw will rotate to move the first slide over the base, and when the second shaft is rotated, the second feed screw will rotate to move the second slide over the first slide, a one-way clutch mounted on the first drive shaft and provided with a gear, a fluid-operated cylinder mounted on the base, a rack engaged with the gear of the clutch and coupled with the cylinder such that the cylinder when actuated will move the rack and rotate the clutch in the direction which causes the clutch to rotate the feed screw, and means for rotating the second drive shaft independently of the first drive shaft.

2. A machine according to claim 1 where the cylinder moves the rack to and fro so that the first feed screw is turned incrementally, and further comprising a second rack, back gearing connecting the first feed screw with the second rack so that the second rack advances incrementally with the incremental rotation of the first feed screw, means connected with the second rack for moving it back to its initial position after it has undergone numerous incremental advances, a control slide also connected with the rack, and switches located in the path of the control slide for controlling the operation of the machine.

3. A machine according to claim 2 further including a stop for limiting the distance that the first cylinder moves the first rack so that the incremental advance of the first slide toward the grinding wheel is precisely controlled.

4. A machine according to claim 3 wherein the feed means further comprises a supplemental stop which further limits the distance that the first cylinder moves the first rack, the supplemental stop being moved into position upon actuation of one of the switches by the control slide.

5. A machine according to claim 4 wherein the feed means further comprises: a gear mounted on the second drive shaft, a third cylinder mounted on the base, and a third rack engaged with the gear on the drive shaft and connected with the third cylinder such that movement of the third rack by the third cylinder will cause the drive shaft to turn and thereby displace the second slide in a direction parallel to the axis of rotation for the grinding wheel.

6. A machine for grinding gashes into the end of a rotary cutting tool blank, such as the blank from which an end mill is derived, said machine comprising: a base; a grinding wheel that revolves about an axis; means for supporting the grinding wheel on the base and for moving the grinding wheel such that its periphery repeatedly passes through a grind point that is fixed in position with respect to the base; a work head for holding a cutting tool blank; indexing means on the work head for rotating the blank incrementally about the tool axis as the tool is held in the work head; means for supporting the work head on the base such that the end of a blank that is held by the work head is at the grind point, and for further permitting the work head to pivot for purposes of adjustment about a first axis that is parallel to the axis of the grinding wheel and about a second axis that is perpendicular to the first axis; and first feed means for incrementally advancing the work head so that the cutting tool blank carried by it moves into the grind point, thus enabling the grinding wheel to cut into the blank and create gashes that open out of the end of the blank; the first feed means and the indexing means being correlated with the means for supporting and moving the grinding wheel such that the first feed means and indexing means change the position of the blank with respect to the base only when the grinding wheel is remote from the grind point and out of contact with the blank, whereby that the blank is held in a fixed position with respect to the base as the grinding wheel cuts into its end.

7. A machine according to claim 6 and further comprising means located on the base along the path made by the periphery of the grinding wheel for dressing the periphery of the grinding wheel to a predetermined profile; wherein the first feed means advances the work head first in large increments and then in small increments, and wherein the dressing means dresses the grinding wheel after the first feed means completes the large incremental advances and before commencing the small incremental advances.

8. A machine according to claim 6 wherein the work head includes a collet chuck for holding the end mill blank firmly on the head member and the indexing means includes a motor for rotating the chuck and the end mill blank within the chuck through a predetermined angle upon response to a signal generated by the feed means.

9. A machine according to claim 8 wherein the collet chuck is connected with a drive collar and the drive collar is driven by the motor; and wherein the indexing means further comprises an indexing ring mounted on the work head and having outwardly opening notches spaced at the intervals that the end mill blank is rotated, each notch having a radial edge and another edge that intersects the periphery of the ring at a greater angle than it intersects the radial edge, and a resilient finger which projects into the notches to precisely position the end mill blank, the motor, upon indexing the end mill blank, rotating the collar such that one notch moves away from the finger and a succeeding notch receives the finger whereupon the motor reverses and drives the radial edge of the succeeding notch against the end of the finger.

10. A machine according to claim 6 wherein the indexing means on the work head is correlated with the first feed means such that the work head incrementally rotates the cutting tool blank through a full revolution between each incremental advance imparted to the work head by the first feed means.

11. A machine according to claim 10 and further comprising second feed means for moving the work head parallel to the first axis and the grinding wheel axis, the second feed means being correlated with the means for supporting and moving the grinding wheel such that the work head is moved by the second feed means only when the grinding wheel is remote from the grind point.

12. A machine according to claim 6 wherein the means for supporting and moving the grinding wheel includes an arm that pivots about an axis that is fixed with respect to the base and is parallel to the first axis and also parallel to the axis of rotation for the grinding wheel.

13. A machine according to claim 6 wherein the first feed means includes a slide, a lead screw extended through the slide, a pinion connected with the lead screw such that it rotates the lead screw when turned in one direction, but not in the other direction, said one direction of rotation causing the work head to advance toward the grind point, a rack engaged with the pinion, means for moving the rack in two directions of translation, both of which cause the pinion to turn, whereby when the rack moves in said one direction, the lead screw will turn and advance the work head, and when the rack moves in the opposite direction, the work head will remain in place.

14. A machine according to claim 13 wherein the first feed means further includes an adjustable stop that controls the distance the rack moves in said one direction of translation, whereby the stop also controls the extent of such incremental advance of the work head toward the grind point.

15. A machine according to claim 14 wherein the means for moving the rack is a fluid-operated cylinder having a piston rod that is connected with the rack; and wherein the adjustable stop lies in the path of the piston rod and controls the distance that the rack moves by preventing further movement of the piston rod.

16. A machine according to claim 6 wherein the first feed means initially moves the work head in a series of large incremental advances and then in a series of small incremental advances.

17. A machine for grinding gashes into the end of a rotary cutting tool blank, such as the blank from which an end mill is derived, said machine comprising: a base; a swing arm mounted upon the base for rotational movement about a first axis; a slide mounted upon the swing arm; a grinding wheel carried on the slide for rotation about a second axis that is parallel to the first axis about which the swing arm rotates; means for causing the swing arm to pivot to and fro on the base such that the periphery of the grinding wheel moves repeatedly into, through, and out of a grind point that is fixed in position with respect to the base; means carried by the swing arm for shifting the slide such that the grinding wheel moves away from the first axis a predetermined distance; means for holding a cutting tool blank with its end at the grind point and for further rotating the blank about the axis of the blank to place different portions of the blank opposite the grinding wheel; feed means for displacing the blank toward and into the grind point so as to enable the wheel to cut into the end of the blank; and dressing means mounted on the base remote from the grind point for dressing the grinding wheel when the grinding wheel is remote from the grind point and is thrust away from the first axis by the predetermined distance.

18. A machine according to claim 17 wherein the means for dressing the grinding wheel includes a base frame mounted on the base, a cam mounted firmly on the base frame, and at least one dressing arm having a follower that bears against the cam, a hard dressing element mounted on the arm and facing the periphery of the grinding wheel, and means for moving the arm such that the follower upon it moves along the cam, the cam being configured to cause the dressing element, upon movement of the arm, to trace the desired profile for the periphery of the grinding wheel.

19. A machine according to claim 18 wherein the dressing arm pivots relative to the frame base about two axes which are connected at right angles with respect to each other.

20. A machine according to claim 18 and further comprising means for exerting a force upon the dressing arm to hold the follower against the cam and the dressing element against the periphery of the wheel.

21. A machine according to claim 17 wherein the feed means displaces the blank incrementally, both through rough feed increments and fine feed increments with the fine feed increments following the rough feed increments and being of a lesser magnitude, and wherein the dressing means dresses the grinding wheel after the end of the rough feed and before the commencement of the fine feed.

22. A machine according to claim 17 wherein the feed means displaces the blank incrementally, first in a series of large increments and then in a series of small increments, and wherein the grinding wheel is positioned at and thrust on its slide toward the dressing means after completion of the large incremental displacements and before commencement of the small incremental displacements.

* * * * *